US006532946B1

(12) United States Patent
Paquette

(10) Patent No.: US 6,532,946 B1
(45) Date of Patent: Mar. 18, 2003

(54) APPARATUS AND METHOD FOR DISPENSING CLEANING BALLS USED IN PAINTBALL GUN

(76) Inventor: Ryan A. Paquette, 9195 S. Meyer La., Apt. 10110, Oak Creek, WI (US) 53154

( * ) Notice: Subject to any disclaimer, the term of this patent is extended or adjusted under 35 U.S.C. 154(b) by 0 days.

(21) Appl. No.: 10/006,024

(22) Filed: Dec. 6, 2001

(51) Int. Cl.[7] ..... F41B 11/02
(52) U.S. Cl. ..... 124/49
(58) Field of Search ..... 124/49, 50, 73, 124/74

(56) References Cited

U.S. PATENT DOCUMENTS 1,205,166 A * 11/1916 Dettra
4,531,503 A 7/1985 Shepherd ..... 124/76
5,282,454 A 2/1994 Bell et al. ..... 124/49
5,285,765 A 2/1994 Lee ..... 124/50
5,511,333 A 4/1996 Farrell ..... 42/49.01
5,673,679 A * 10/1997 Walters ..... 124/73 X
5,947,100 A 9/1999 Anderson ..... 124/45
5,954,042 A 9/1999 Harvey ..... 124/51.1
6,374,819 B1 * 4/2002 Ming-Hsien ..... 124/49
6,460,530 B1 * 10/2002 Backeris et al. ..... 124/49

* cited by examiner

*Primary Examiner*—John A. Ricci
(74) *Attorney, Agent, or Firm*—Andrus, Sceales, Starke & Sawall, LLP

(57) ABSTRACT

A paintball gun for propelling paintballs has a barrel formed with a loading tube and a hopper for feeding paintballs into the loading tube for delivery to the barrel. A cleaning ball storage and feeding device is interconnected between the hopper and the loading tube for selectively feeding cleaning balls into the barrel to purge the barrel from shell particles and filler paint deposited from a previously propelled ruptured paintball.

14 Claims, 6 Drawing Sheets

APPARATUS AND METHOD FOR DISPENSING CLEANING BALLS USED IN PAINTBALL GUN

FIELD OF THE INVENTION

This invention relates broadly to the field of paintball equipment and, more particularly, pertains to a dispenser mounted on a paintball gun for introducing cleaning balls used in purging the barrel of a paintball gun of deposits from a previously ruptured paintball.

BACKGROUND OF THE INVENTION

The game of paintball has enjoyed great success in recent years and is a game in which two or more teams try to capture one another's flags. The players on each of the teams each carry a $CO_2$ powered gun that shoots paintballs that are propelled by short bursts of the pressurized gas. Typically, paintballs are gelatin covered, spherical capsules having a diameter of approximately 11/16 of an inch that contain a colored liquid. When a player is hit with a paintball from an opponent's gun, the paintball ruptures and leaves a colored mark on the hit player who then must leave the game.

As the game of paintball has grown in sophistication, semi-automatic paintball guns, guns that sequentially fire paintballs as fast as the trigger can be repeatedly pulled by the user, have become more prevalent. A high firing rate capacity of semi-automatic paintball guns results in the occasional rupture or breakage of paintballs which leave shell or capsule particles and filler paint deposits on the inside surface of a paintball gun barrel. Such deposits negatively affect the performance of the paintball gun.

The cleaning of the inside surface of the paintball gun barrel typically involves using a rod-like cleaning device such as disclosed in U.S. Design Pat. No. Des 393,115 issued Mar. 31, 1998 to Bell et al. One end of this device is provided with a series of spaced apart, disc-like wiping elements such that it is inserted into the barrel of the paintball gun and pulled through to expel the build up of deposits inside the barrel. This type of cleaning process is not ideally effective during paintball competition because of the time involved for cleaning and the need for an additional rod-like accessory which must be carried by the operator of the paintball gun. The use of such accessory unduly disrupts the normal operation of the paintball gun.

In order to improve upon the prior art, the present inventor has set forth in pending U.S. patent application Ser. No. 09/993,002 filed Nov. 14, 2001 (which is herein incorporated by reference), a compressible, absorbent cleaning ball which may be inserted and propelled within the paintball gun to remove ruptured paintball debris from the paintball gun barrel. In the aforementioned application, it is explained that after the hopper of the paintball is removed and paintballs in the loaded tube of the gun are extracted, a single cleaning ball is inserted into the loading tube for delivery into the barrel. Once this has been done, the hopper may be reattached and normal gun operation may continue with the cleaning ball being fired through the barrel to remove paintball shell particles and filler paint from a previously ruptured paintball.

Although the process described above provides adequate cleaning of the paintball gun barrel, it is desirable to make the loading of the cleaning ball faster and less involved. Accordingly, there is a need for a dispensing unit which can be adapted for mounting on the paintball gun to expedite introduction of the cleaning ball and promote faster cleaning.

SUMMARY OF THE INVENTION

It is a general object of the present invention to provide a storage and feeding device for selectively feeding cleaning balls into the barrel for purging the barrel of ruptured paintball debris.

It is also an object of the present invention to provide a cleaning ball dispenser which is adapted to be mounted on a variety of paintball guns.

It is an additional object of the present invention to provide a cleaning ball storage and feeding device which may be conveniently interconnected between the hopper and the loading tube of a paintball gun.

It is a further object of the present invention to provide a dispenser for storing a plurality of cleaning balls in series fashion.

It is another object of the present invention to provide a cleaning ball dispenser which is cost affordable and reliable in use.

Yet another object of the present invention is to provide an improved method of dispensing cleaning devices for purging the barrel of a paintball gun.

In one aspect of the invention, a paintball gun for propelling paintballs has a barrel formed of a loading tube and a hopper for feeding paintballs into the loading tube for delivery to the barrel. The invention is improved wherein a cleaning ball storage and feeding device is interconnected between the hopper and the loading tube for selectively feeding cleaning balls into the barrel to purge the barrel from shell particles and filler paint deposited from a previously propelled ruptured paintball. The storage and feeding device has a first portion for carrying paintballs and cleaning balls to the loading tube, and a second portion in communication with the first portion for storing and feeding a plurality of cleaning balls. The second portion of the storage and feeding device includes a spring-loaded holding assembly for maintaining the position of the cleaning balls.

In another aspect of the invention, a dispenser is provided for cleaning devices used in cleaning a barrel of a paintball gun having a loading tube in communication with the barrel and a hopper for feeding paintballs into the loading tube for delivery to the barrel. The dispenser includes a body having a tubular connecting elbow with an inlet attached to the hopper and an outlet connected to the loading tube. The body also has a storage and feed tube in communication with the connecting elbow for storing and feeding a series of paintball gun barrel cleaning devices. A spring-loaded door is provided between the connecting elbow and the storage and feed tube for selectively preventing and permitting passage of the cleaning device from the storage and feed tube into the connecting elbow for delivery to the barrel of the paintball gun. The body is formed with a loading hole permitting access for pushing one of the cleaning devices from the storage and feed tube into the connecting elbow. The storage and feed tube includes a plunger with a loading knob projecting therefrom. The plunger is biased upwardly by a spring acting against the bottom surface thereof, and the plunger has a top surface engageable with one of the cleaning devices. The body is formed with an elongated slot along the length of the storage and feed tube, the slot having a curved portion at a bottom end thereof. The loading knob projects through and rides in the slot in a working condition, and is captured in the curved portion of the slot to hold the plunger in spring tension in a locked condition during which the cleaning devices are loaded into the storage and feed tube. The spring-loaded door is pivotally mounted on the body between a closed position and an open position. The body includes a removable plug at a bottom end of the storage and feed tube for permitting access thereto.

The invention also contemplates a method of dispensing cleaning devices used in cleaning a barrel of a paintball gun having a loading tube in communication with the barrel, and a hopper for feeding paintballs into the loading tube for delivery to the barrel. The method includes the steps of providing a dispenser having a pathway for normally carrying paintballs from the hopper to the loading tube, and a storage and feed tube in communication with the pathway for storing and feeding a series of paintball gun barrel cleaning devices; interconnecting the dispenser between the hopper and the loading tube; and periodically transferring one of the cleaning devices from the storage and feed tube into the pathway for delivery to the paintball gun barrel. The step of periodically transferring one of the cleaning devices includes a step of manually pushing one of the cleaning devices into the pathway.

Another aspect of the invention relates to a paintball gun for propelling paintballs and having a barrel formed with a loading tube and a hopper for feeding a first type of paintballs into the loading tube for delivery to the barrel. The invention is improved wherein a ball storage and feeding device is interconnected between the hopper and the loading tube for storing a second type of paintballs and selectively feeding the second type of paintballs from a storage and feed tube to a connecting elbow.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
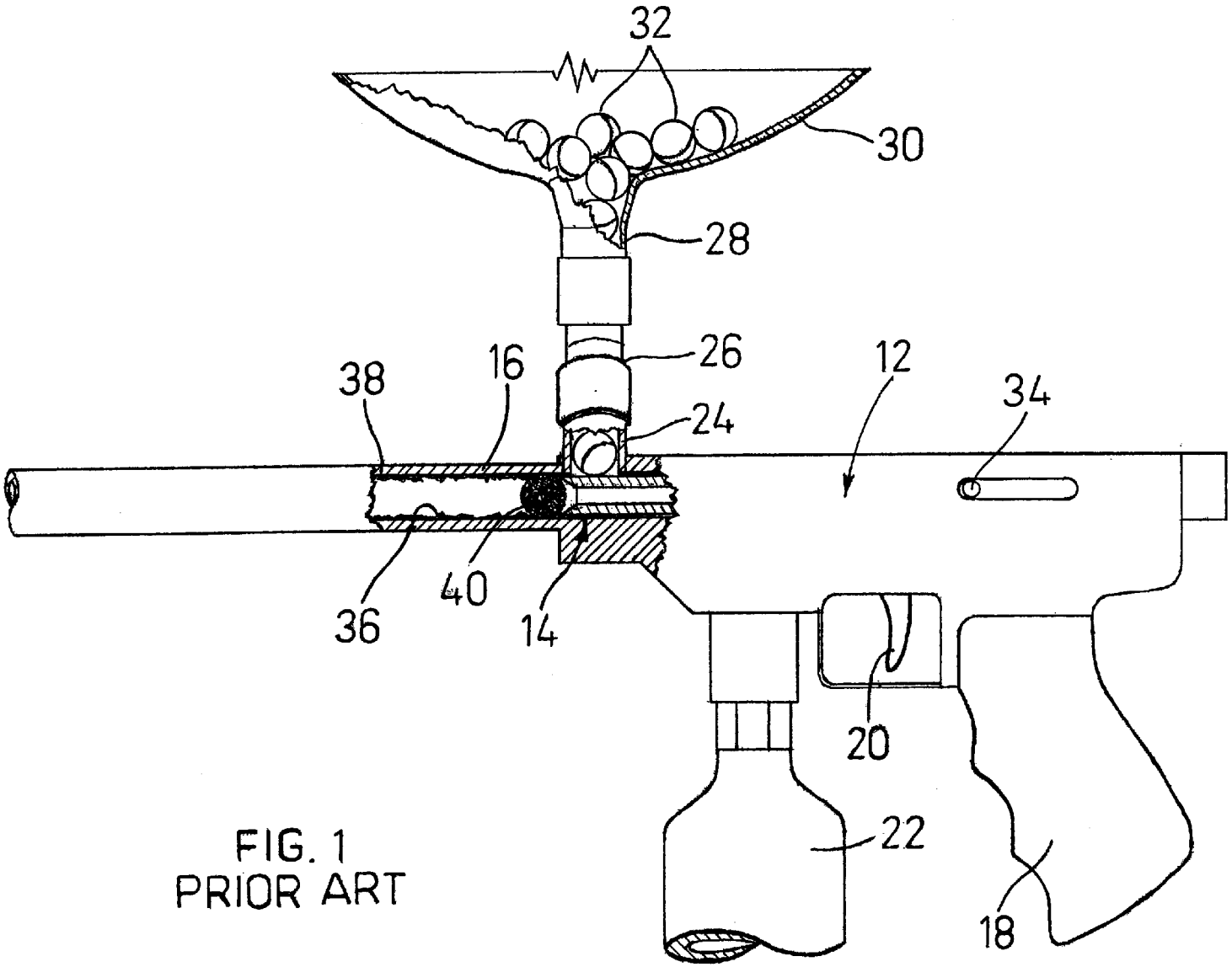
FIG. 1 PRIOR ART
FIG. 1 is a perspective view of a conventional PRIOR ART paintball gun.

Referring now the drawings, FIG. 1 illustrates a conventional prior art paintball gun 12. Paintball gun 12 is representative of a semi-automatic firing type having a forward chamber 14, a barrel 16 and a hand grip 18 having a trigger 20. Paintball gun 12 is connected to a supply of pressurized gas such as $CO_2$ or nitrogen contained within a canister 22. Extending perpendicularly from barrel 16 is a loading tube 24 which is coupled by a removable elbow fitting 26 to a discharge tube 28 on a replaceable supply hopper 30 filled with a plurality of paintballs 32. Paintballs 32 normally fall by gravity through the discharge tube 28 and loading tube 24 into the chamber 14 where they are advanced by a cocking bolt 34. Once in the position shown in FIG. 1, the paintballs 32 can be sequentially fired from the paintball gun 12 by pressure bursts from canister 22 created by a sequential pulls of trigger 20. Although the canister 22 is shown connected directly to the paintball gun 12, it should be understood that the canister 22 could be located remotely and connected to the paintball gun 12 by a flexible hose (not shown).

In the normal use of the paintball gun 12, paintballs 32 occasionally rupture while traveling through the barrel 16 leaving paintball shell and filler material 36 along the inner bore 38 of the barrel 16. As this ruptured material 36 accumulates, it can negatively affect the performance of the paintball gun 12. Traditionally, a paintball gun operator has been required to carry an accessory in the form of a rod-like cleaning device which is manually pulled through the barrel to expel the ruptured material 36. The rod-like cleaning device is an additional piece of hardware which has to be purchased and carried separately by the paintball gun operator. In addition, use of the rod-like cleaning device generally interrupts the normal fast pace of the paintball competition.

In order to provide a simplified cleaning device, the present inventor, in his previously noted pending patent application, has set forth a spherical projectile or cleaning ball 40 of compressible, absorbent material having substantially the same size and shape of a paintball 32 disposed in and propelled through the barrel 16 of the paintball gun 12 without cleaning fluid for purging the barrel 16 of shell particles and filler paint from a previously propelled ruptured paintball.

The above-referenced patent application also describes that to use the cleaning ball 40, the hopper 30 is removed and the paintballs 32 in the loading tube 24 are extracted. The gun operator then inserts a single cleaning ball 40 in the loading tube 24 after which the hopper 30 may be reattached. Once the cocking bolt 34 has advanced the cleaning ball 40, the cleaning ball 40 is fired just as a paintball 32 would be. As the cleaning ball 40 travels axially down the bore 38 of the barrel 16, it collects and scrapes away the shell particles and filler paint 36, and expels matter with it as it leaves the barrel 16. The cleaning ball 40 may then be reused as is, or may be rinsed clean with water and dried for reuse. The design of the cleaning ball 40 is such that only a single cleaning ball should sufficiently clean the barrel 16 and no further action is necessary until the next paintball breakage.

Although such use of cleaning ball 40 is satisfactory, the present invention contemplates a faster, more efficient loading of and a repository for several cleaning balls 40*a*.

Figure 2:
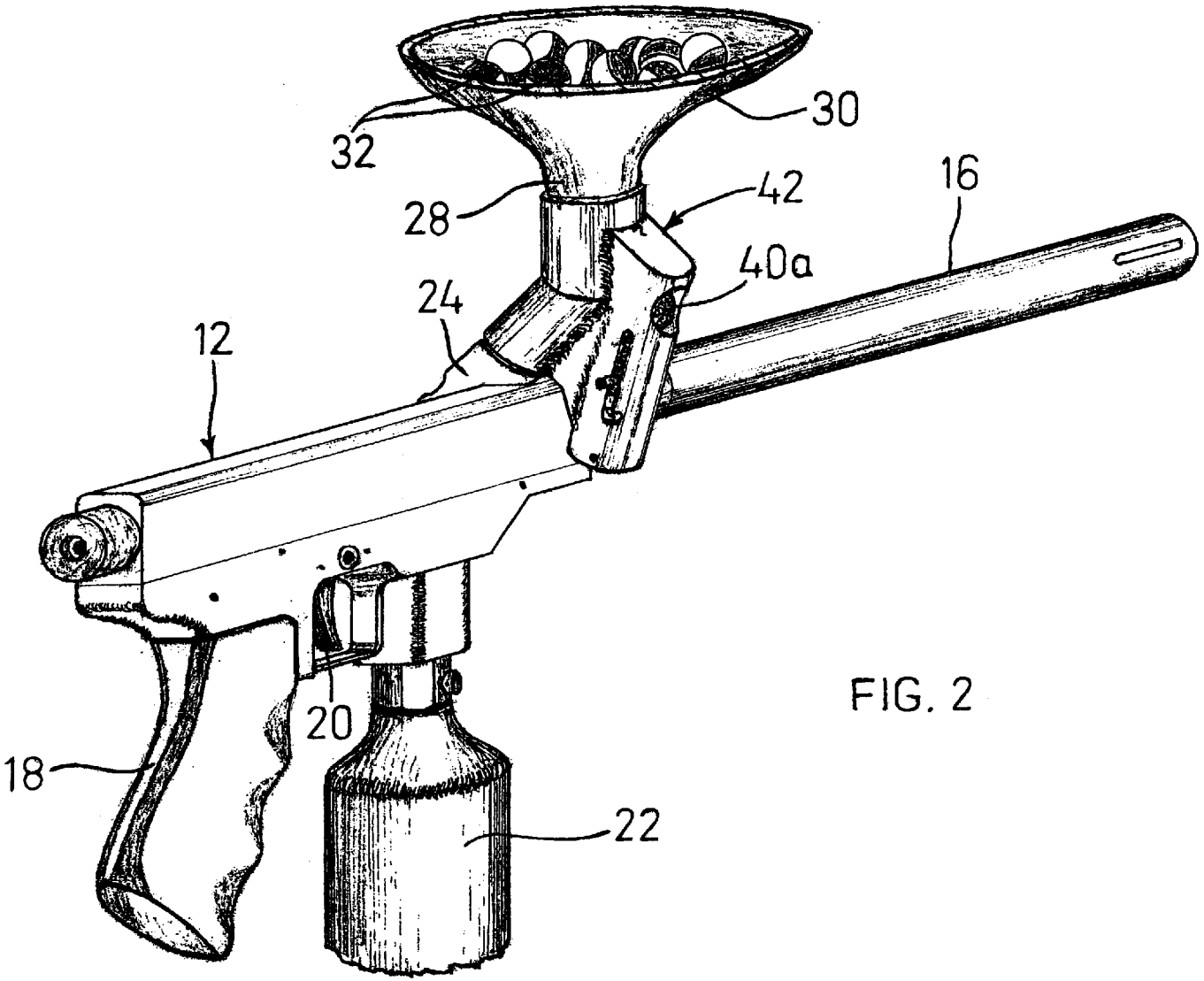
FIG. 2 is a perspective view of a paintball gun embodying the storage and feeding device of the present invention.

In accordance with the present invention, there is provided a cleaning ball storage and feeding device 42 such as is shown in FIG. 2, interconnected between the hopper 30 and the loading tube 24 for selectively feeding cleaning balls 40*a* into the barrel 16 to purge the barrel 16 from shell particles and filler paint 36 deposited from a previously ruptured paintball 32. As will be appreciated, the use of the storage and feeding device 42 makes it unnecessary to remove the hopper 30 each time a cleaning ball 40*a* is needed.

Figure 3:
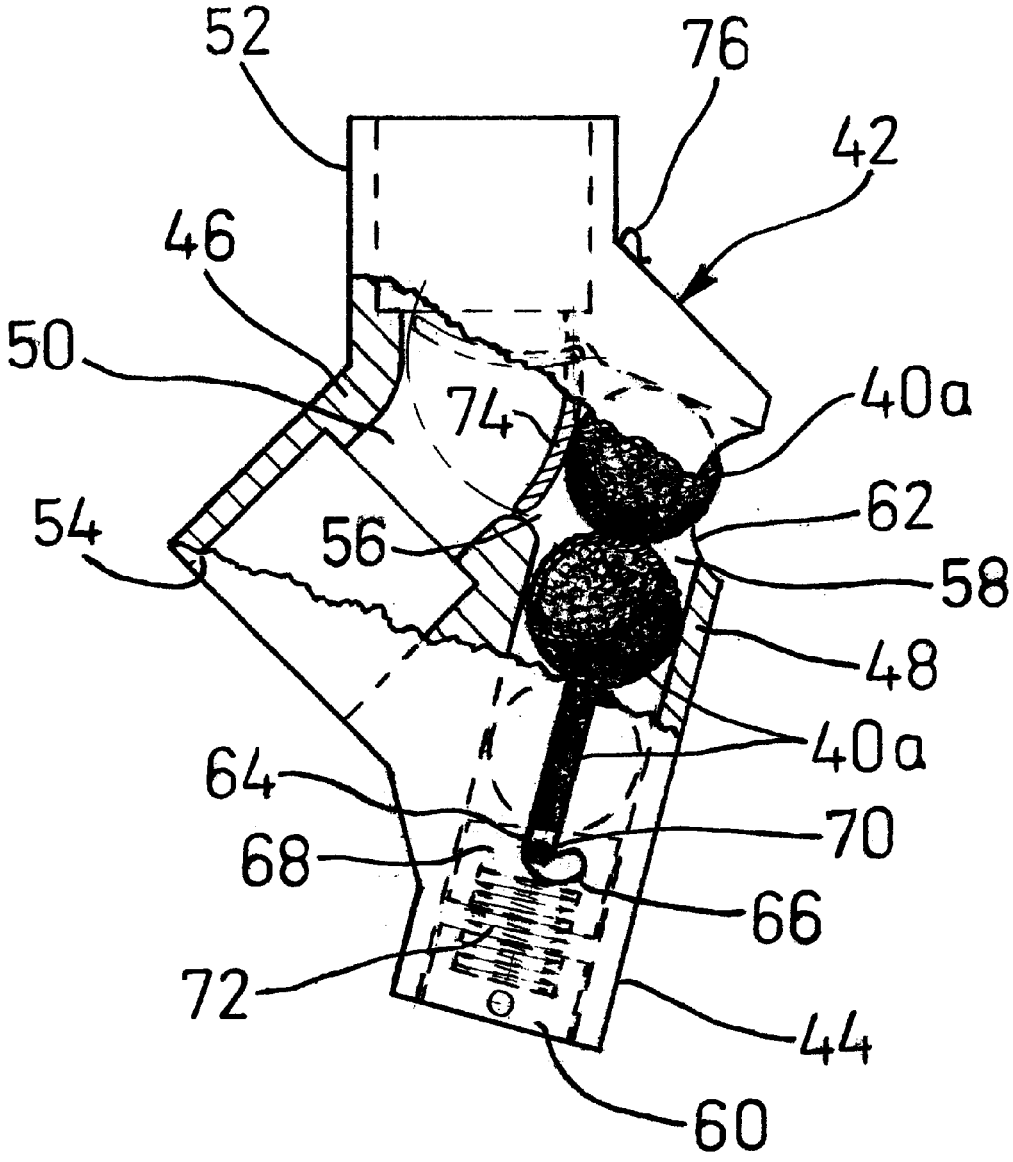
FIG. 3 is a front view of the storage feeding device per se with parts broken away and in cross section to show the internal structure thereof.
Figure 4:
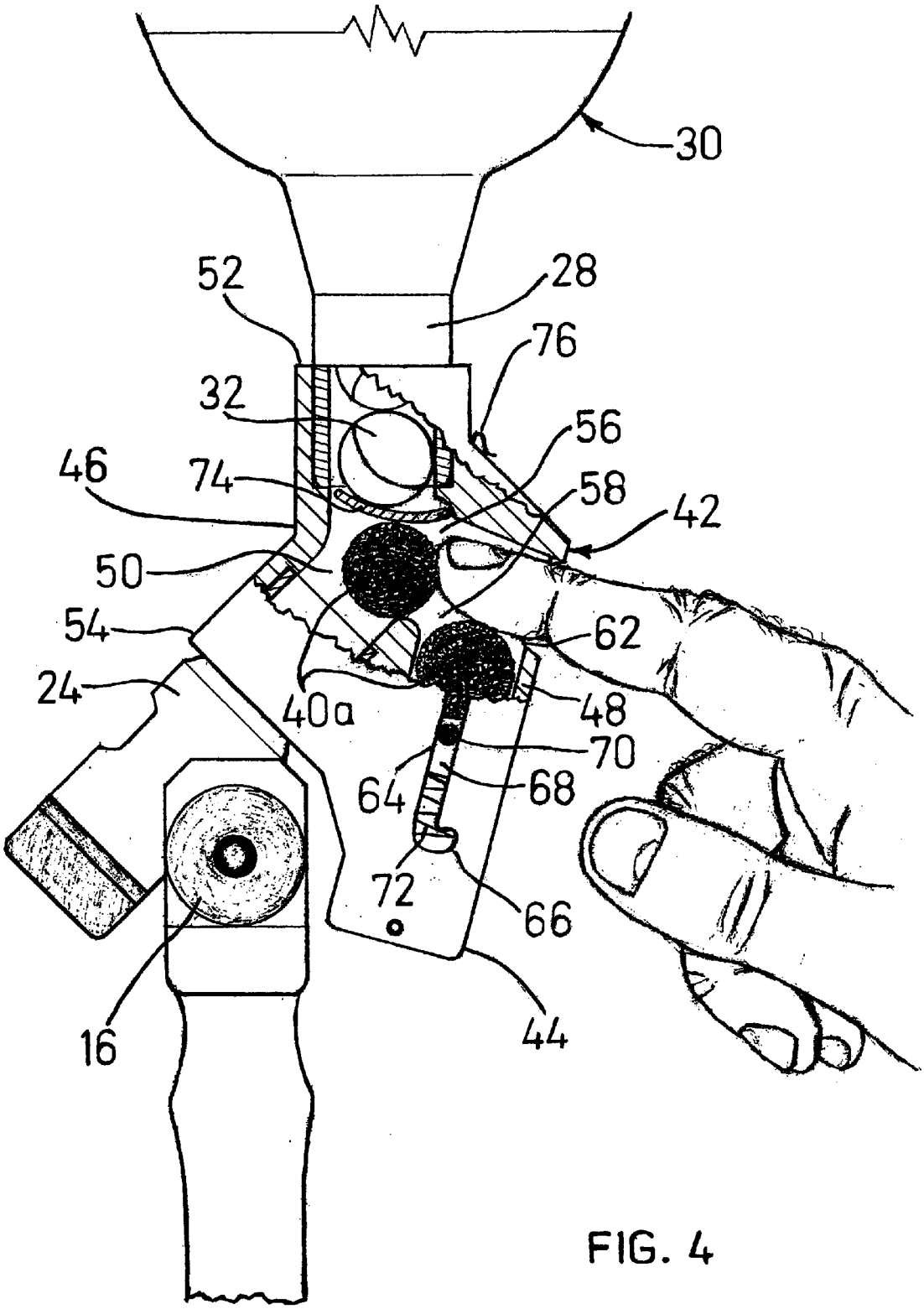
FIG. 4 is a view similar to FIG. 3 showing the manner in which a cleaning ball is introduced into the loading tube.

Cleaning ball storage and feeding device 42 functions as a dispenser which is best shown in FIGS. 3 and 4 and includes a body 44 having a first portion in the form of a tubular connecting elbow 46 carrying paintballs 32 and cleaning balls 40*a* to the loading tube 24, and a second portion in the form of a storage and feed tube 48 in communication with the first portion for storing and feeding a plurality of cleaning balls 40*a*. The second portion 48 of body 44 includes a spring-loaded holding assembly for maintaining the position of the cleaning balls 40*a*.

Connecting elbow 46 defines an internal curved pathway 50 for normally carrying paintballs 32 to the loading tube 24, and occasionally transferring a cleaning ball 40*a* from the storage and feed tube 48 to the loading tube 24. Connecting elbow 46 has an inlet 52 which is attached, such as by a press fit, to the discharge tube 28 of hopper 30, and an outlet 54 which is connected, also such as by a press fit, to the top of the loading tube 24. The mid-portion of the connecting elbow 46 is formed with an opening 56 which provides communication to the upper end of the storage and feed tube 48.

Storage and feed tube 48 is provided with an elongated chamber 58 for holding a series of cleaning balls 40*a* in a generally end-to-end array. Chamber 58 is closed at its bottom end by a removable plug 60, and is accessible at its upper end by a loading hole 62 which opens rearwardly of the dispenser 42. A forward wall in storage and feed tube 48 is formed with a slot 64 running substantially longitudinally of the wall and enabling inspection into the chamber 58. The slot 64 has a curved, upturned portion 66 at its bottom end for a purpose to be explained hereafter. Disposed for movement in the chamber 58 is a plunger 68 having a loading knob 70 which rides in the slot 64. Plunger 68 has a bottom end against which a feed spring 72 is biased so as to normally force the plunger 68 in an upward direction and push the cleaning balls 40*a* upwardly so that the top ball 40*a* is pushed against the top of the chamber 58. A top end of the plunger 68 is ramped to ensure that the balls 40*a* are not pushed out of the loading hole 62. A door 74 is pivotally mounted in the dispenser 42 between open and closed positions and provided with a spring 76 so that it normally closes the opening 56 between the pathway 50 and the chamber 58 so that the pathway 50 is not obstructed in normal paintball play mode.

Prior to paintball play, the paintball gun elbow fitting 26 is replaced by the dispenser 42 between the hopper 30 and the loading tube 24. The plunger 68 is then lowered against spring 72 with the loading knob 70 being retained in the upturned bottom end 66 of the slot 64 in a locked condition so that the cleaning balls 40*a* can be loaded via the loading hole 62 into chamber 58. Once the chamber 58 is full, the loading knob 70 is released from the upturned bottom end 66 of the slot 64 so that the spring 72 forces the balls 40*a* upwardly into a working condition. Upon paintball breakage in the barrel 16 during play, the paintball gun 12 is inverted so that the paintballs 32 are cleared of loading tube 24. As seen in FIG. 4, the topmost cleaning ball 40*a* in chamber 58 is then forced through the spring-loaded door 74 by the player's finger via the loading hole 62 so that the cleaning ball 40*a* enters the loading tube 24. As the finger is withdrawn and the gun 12 released to its normal attitude, the door 74 springs shut and the cleaning ball 40*a* is gravity fed into the forward chamber 14. The ball 40*a* is then fired through the barrel 16 after which normal paintball cleaning and gun operation continues.

Figure 6:
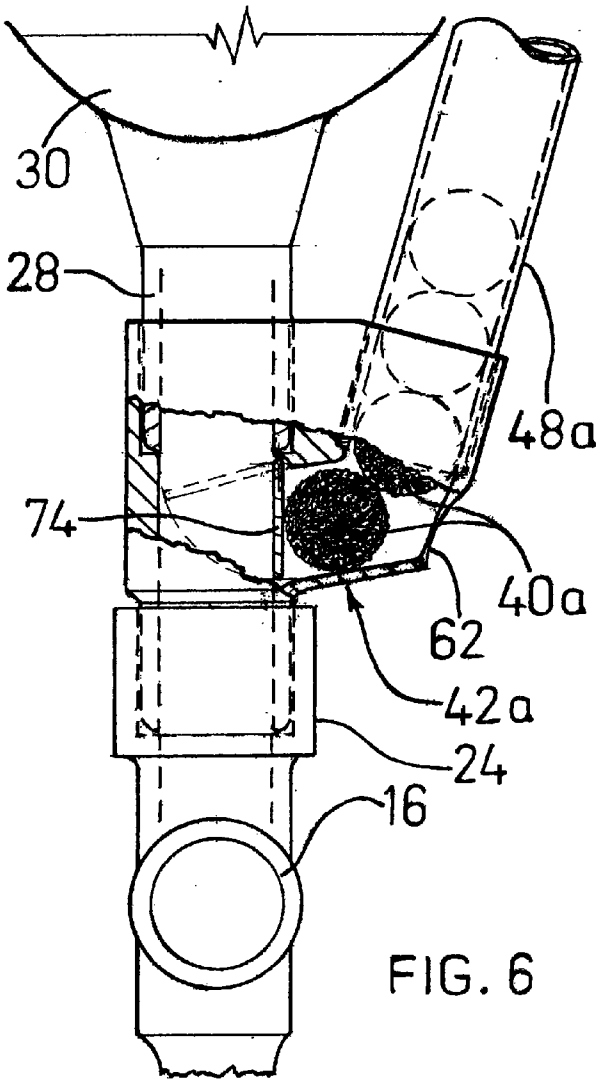
FIG. 6 is a view similar to FIG. 5 rotated 90°.
Figure 5:
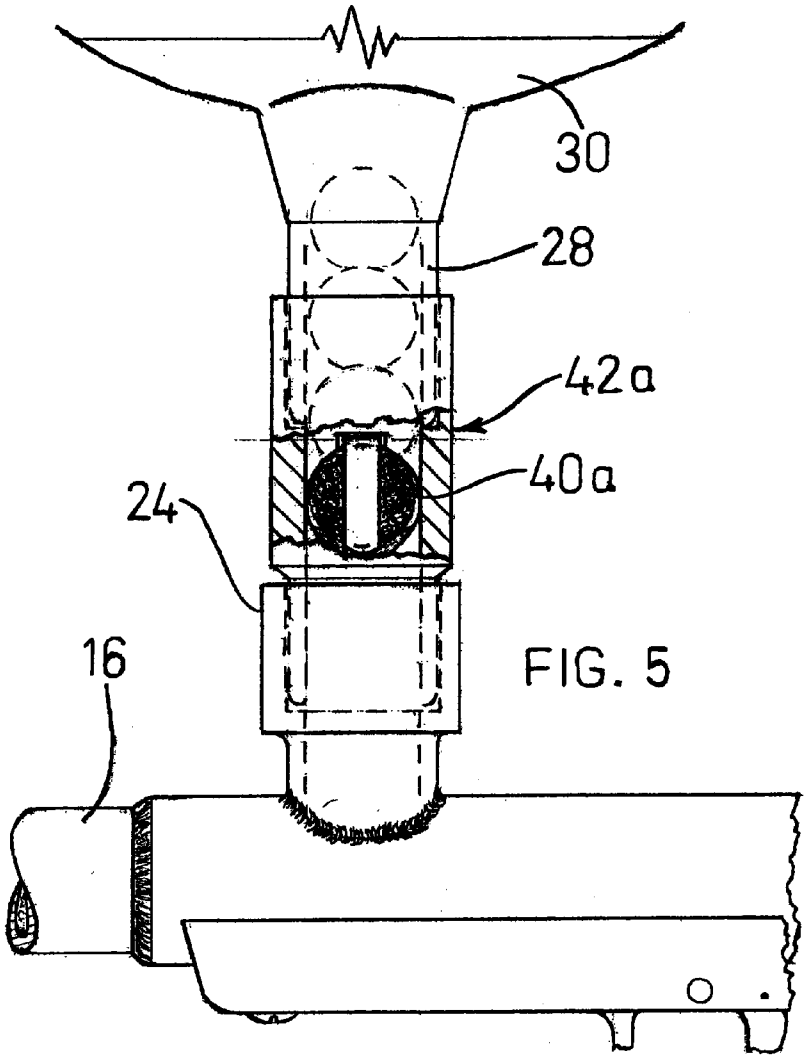
FIG. 5 is an elevational view in partial cross section of an alternative embodiment of the storage and feeding device.

FIGS. 5 and 6 illustrate an alternative embodiment in which the storage and feeding device 42*a* is provided with a gravity fed, upwardly angled, removable storage and feed tube 48*a* without slot 64, plunger 68, and spring 72. In this version, cleaning balls 40*a* are loaded by gravity into the tube 48*a* and remain separated from loading tube 24 by the normally closed biased door 74. When it is desired to introduce a cleaning ball 40*a*, the operator places his or her finger through loading hole 62 and pushes a cleaning ball 40*a* against the door 74. In this fashion, the door will move upwardly (as shown in phantom in FIG. 6) to enable the cleaning ball 40*a* to be delivered to the loading tube 24.

While the storage and feeding device 42, 42*a* has been described as a separate unit to be interposed between the hopper 30 and the loading tube 24, it should be noted that the device 42, 42*a* could be integral with the hopper 30 if desired.

Figure 7:
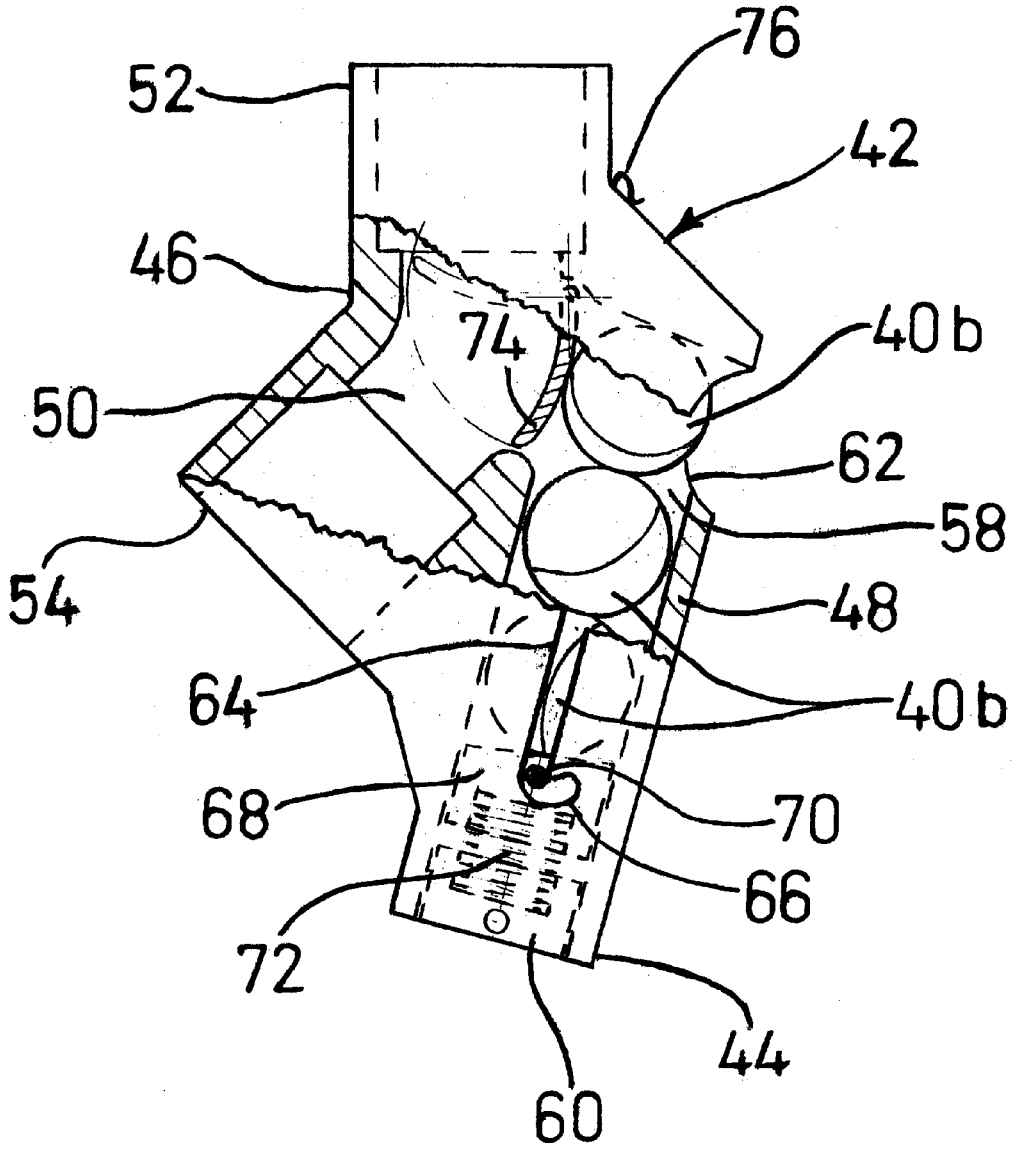
FIG. 7 is a view similar to FIG. 3 showing the storage and feeding device equipped with spherical projectiles other than cleaning balls.

Also, it should be understood that, in some cases, it may be desirable to use the storage and feeding device 42, 42*a* to store and feed a series of higher quality paintballs or other spherical projectiles 40*b* in the storage and feed tube 48, 48*a*, (FIG. 7) such as when the paintball competition involves sniping. In this design, the high quality paintballs 40*b* are substituted for the cleaning balls 40*a* and operation is similar to that described above.

It should be appreciated that the dispenser 42, 42*a* of the present invention is inexpensive, can be retrofit to existing paintball guns and makes loading of the cleaning balls 40*a* faster and less complicated. The operation of the paintball gun 12 thus becomes more valuable to a wide range of variously skilled players. Although it is preferable to provide the main body of dispenser 42, 42*a* as a one-piece design, the invention contemplates the assembly of two or more parts to obtain the same quick loading result.

While the invention has been described with reference to the preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth in the following claims.

I claim:

1. In a paintball gun for propelling paintballs having a barrel formed with a loading tube and a hopper for feeding paintballs into the loading tube for delivery to the barrel, the improvement comprising:

a cleaning ball storage and feeding device interconnected between the hopper and the loading tube for selectively feeding cleaning balls into the barrel to purge the barrel from shell particles and filler paint deposited from a previously propelled, ruptured paintball.

2. The improvement of claim 1, wherein the storage and feeding device has a first portion for carrying paintballs and cleaning balls in the loading tube, and a second portion in communication with the first portion for storing and feeding a plurality of cleaning balls.

3. The improvement of claim 2, wherein the second portion of the storage and feeding device includes a spring-loaded holding assembly for maintaining the position of the cleaning balls.

4. A dispenser for cleaning devices used in cleaning a barrel of a paintball gun having a loading tube in communication with the barrel and a hopper for feeding paintballs into the loading tube for delivery to the barrel, the dispenser comprising:

a body having a tubular connecting elbow with an inlet attached to the hopper and an outlet connected to the loading tube, the body also having a storage and feed tube in communication with the connecting elbow for storing and feeding a series of paintball gun barrel cleaning devices, there being a spring-loaded door between the connecting elbow and the storage and feed tube for selectively preventing and permitting passage of a cleaning device from the storage and feed tube into the connecting elbow for delivery to the barrel of the paintball gun.

5. The dispenser of claim 4, wherein the body is formed with a loading hole permitting access for pushing one of the cleaning devices from the storage and feed tube into the connecting elbow.

6. The dispenser of claim 4, wherein the storage and feed tube includes a plunger with a loading knob projecting therefrom, the plunger being biased upwardly by a spring acting against a bottom surface thereof and the plunger having a top surface engageable with one of the cleaning devices.

7. The dispenser of claim 6, wherein the body is formed with an elongated slot along the length of the storage and feed tube, the slot having a curved portion at a bottom end thereof.

8. The dispenser of claim 7, wherein the loading knob projects through and rides in the slot in a working condition, and is captured in the curved portion of the slot to hold the plunger in spring tension in a locked condition during which the cleaning devices are loaded into the storage and feed tube.

9. The dispenser of claim 4, wherein the spring-loaded door is pivotally mounted in the body between a closed position and an open position.

10. The dispenser of claim 4, wherein the body includes a removable plug at a bottom end of the storage and feed tube for permitting access thereto.

11. The dispenser of claim 4, wherein the storage and feed tube is gravity fed.

12. A method of dispensing cleaning devices used in cleaning a barrel of a paintball gun having a loading tube in communication with the barrel, and a hopper for feeding paintballs into the loading tube for delivery to the barrel, the method comprising the steps of:

providing a dispenser having a pathway for normally carrying paintballs from the hopper to the loading tube, and a storage and feed tube in communication with the pathway for storing and feeding a series of paintball gun barrel cleaning devices;

interconnecting the dispenser between the hopper and the loading tube; and periodically transferring one of the cleaning devices from the storage and feed tube into the pathway for delivery to the paintball gun barrel.

13. The method of claim 12, wherein the step of periodically transferring one of the cleaning devices includes the step of manually pushing one of the cleaning devices into the pathway.

14. In a paintball gun for propelling paintballs having a barrel formed with a loading tube and a hopper for feeding a first type of paintballs into the loading tube for delivery to the barrel, the improvement comprising:

a ball storage and feeding device interconnected between the hopper and the loading tube for storing a second type of paintballs in a storage and feed tube and selectively feeding the second type of paintballs from the storage and feed tube to a tubular connecting elbow in communication with the loading tube and the barrel.

* * * * *